United States Patent [19]

Akiyama

[11] Patent Number: 4,498,847

[45] Date of Patent: Feb. 12, 1985

[54] CONTROL SYSTEM FOR VARIABLE DISPLACEMENT HYDRAULIC PUMPS

[75] Inventor: Teruo Akiyama, Yokohama, Japan

[73] Assignee: Kabushiki Kaisha Komatsu Seisakusho, Tokyo, Japan

[21] Appl. No.: 508,100

[22] Filed: Jun. 27, 1983

[30] Foreign Application Priority Data

Jun. 29, 1982 [JP] Japan ..... 57-110722
Jun. 29, 1982 [JP] Japan ..... 57-096540[U]
Jun. 29, 1982 [JP] Japan ..... 57-096541[U]

[51] Int. Cl.[3] ..... F04B 49/00

[52] U.S. Cl. ..... 417/216; 417/218; 417/222; 60/430; 60/447; 60/452; 60/486

[58] Field of Search ..... 417/213, 216, 218–222; 60/428, 430, 445, 447, 452, 486

[56] References Cited

U.S. PATENT DOCUMENTS

| | | | |
|---|---|---|---|
| 2,732,808 | 1/1956 | Stoyke | 417/222 |
| 3,732,036 | 5/1973 | Busbey et al. | 417/216 |
| 3,767,327 | 10/1973 | Wagenseil | 417/216 |
| 3,841,795 | 10/1974 | Ferre et al. | 417/216 |
| 3,990,352 | 11/1976 | Nishida et al. | 91/434 |
| 4,065,228 | 12/1977 | McMillan | 417/216 X |
| 4,248,573 | 2/1981 | Uehara et al. | 417/216 |
| 4,248,574 | 2/1981 | Uehara et al. | 417/216 |

FOREIGN PATENT DOCUMENTS

| | | | |
|---|---|---|---|
| 2513548 | 10/1976 | Fed. Rep. of Germany | 417/218 |
| 55-1478 | 1/1980 | Japan | 417/216 |
| 57-97089 | 6/1982 | Japan | 417/216 |

*Primary Examiner*—William L. Freeh
*Assistant Examiner*—Paul F. Neils
*Attorney, Agent, or Firm*—Armstrong, Nikaido, Marmelstein & Kubovick

[57] ABSTRACT

A control system for variable displacement hydraulic pumps for use in a hydraulically operated construction vehicle having a fixed displacement hydraulic pump, a plurality of reducing valves operatively interlocked with work implement control valve units of the vehicle disposed on the delivery sides of the variable displacement pumps, control sections for controlling respective flow rate of the variable displacement pumps and equipment for exerting delivery pressures of both the fixed and variable displacement pumps and output pressure of the reducing valve on the control units. The control system exhibits three control functions, i.e., flow control for varying the angle of the swash plate of the variable displacement pump in proportion to the manipulating position of the respective work implement controlling valve, constant torque control in proportion to the delivery pressures of the variable displacement pumps, and cut-off control for reducing relief losses.

6 Claims, 9 Drawing Figures

CONTROL SYSTEM FOR VARIABLE DISPLACEMENT HYDRAULIC PUMPS

BACKGROUND OF THE INVENTION

1. Field of The Invention

This invention relates to a control system for variable displacement hydraulic pumps for use in hydraulically operated construction vehicles such as for example power shovels etc., with a gyratory upper body, and more particularly to such a control system as having three control functions, i.e., flow control for varying the angle of swash plate of the pump in proportion to the manipulating position of respective work implement controlling valve, constant torque control in proportion to the delivery pressures of the variable displacement hydraulic pumps, and cut-off control for reducing relief losses.

2. Description of The Prior Art

As disclosed in the Japanese patent application Laid-open Publication No. Sho 55-1478, the vehicles of the kind specified have so far employed variable displacement hydraulic pumps as hydraulic pumps therefor to achieve effective utilization of the engine output, and most of them have been of the constant torque control type.

If only the constant torque control is employed, however, the control system has been disadvantageous in that (1) the hydraulic pump is located at a maximum swash plate angular position even when the vehicle is not working, and so the total discharge volume (the delivery) is wasted as a pressure loss, (2) when the actuator is inching, a greater part of the discharge volume is returned from the valve at its neutral position into a tank resulting in a loss, and (3) when relieving the pressurized fluid, most of the discharge volume turns into a relief loss.

To eliminate the above-mentioned disadvantages, there has been proposed the Japanese patent application Laid-open Publication No. Sho 55-43245.

The above-mentioned invention is arranged such that a hydraulic servo mechanism is used to control the angle of the swash plate of the pump and such reducing valves as a TCC valve, a CO valve and a NC valve are located in a control pressure circuit which provides input for the hydraulic servo mechanism to detect the delivery pressure of the pump and the flow rate of the fluid through the neutral circuit of the valve to vary the control pressure which provides the input for the hydraulic servo mechanism thereby controlling the angle of the swash plate of the pump.

Further, one of the prior art reducing valve means used for the above-mentioned flow rate controls is disclosed in the specification of the U.S. Pat. No. 3,990,352. According to this reducing valve means, two sets of springs for determining the characteristic of the outlet pressure of the reducing valve means are attached to provide a same loading or compressive force, and therefore when the rod on which the two springs are mounted moves, one of the springs having a lower spring constant commences to deflect in the first place. As a result, only one pattern can always be obtained as the characteristic of the outlet pressure.

SUMMARY OF THE INVENTION

This invention has been contemplated in view of the above-mentioned circumstances, and has for its object to provide a control system for variable displacement hydraulic pumps wherein the pump delivery pressure and the control pressure are exerted as a displacement of the piston on the input signal section of the hydraulic servo mechanism adapted to control the angle of the swash plate of the pump and the sum of the pump delivery pressure and the control pressure serves as an input for the hydraulic servo mechanism to control the angle of the swash plate of the pump.

Another object of the present invention is to provide a reducing valve means for controlling the variable displacement hydraulic pumps wherein the loadings of two springs for determining the pressure reduction characteristic are different from each other and the loading of a spring having a higher spring constant is reduced so that it may be actuated earlier thereby enabling an excellent characteristic of the reducing valve to be obtained.

A further object of the present invention is to provide a cut-off valve means for controlling variable displacement hydraulic pumps wherein the actuation force can be reduced so as to reduce the loading of springs; a less critical tolerance is allowable for the concentricity of spools and pistons; jamming of the spools and pistons can be eliminated; not only axial actuating force can be exerted on spools, but also the arrangement is made such that the output pressure of the reducing valve and the forces of the springs can be independently applied to the spools so that adverse effect of non-uniformly compressed springs on the pistons can be eliminated.

To achieve the above-mentioned objects, in accordance with the present invention, there is provided a control system for variable displacement hydraulic pumps comprising a fixed displacement hydraulic pump for supplying a control fluid pressure for a hydraulic servo mechanism, a plurality of reducing valve means operatively interlocked with work implement control valve units disposed on the delivery sides of the plurality of variable displacement hydraulic pumps, said reducing valve means being adapted to convert the delivery pressure of said fixed displacement hydraulic pump into the output pressure of the reducing valve in proportion to respective displacements of said control valve units by the manipulation thereof, control units for said variable displacement hydraulic pumps, each control unit including a servo piston section adapted to selectively receive the delivery pressure of said fixed displacement hydraulic pump on either side thereof to thereby control the delivery pressures of said variable displacement hydraulic pumps, a guide section adapted to control the delivery pressure of said fixed displacement hydraulic pump to selectively direct it on either side of said servo piston section and an input signal section adapted to receive the delivery pressure of said fixed displacement hydraulic pump, the output pressure of said reducing valve means and respective delivery pressures of said variable displacement hydraulic pumps so as to control said guide section, and means adapted to exert the delivery pressure of said fixed displacement hydraulic pump, the output pressure of said reducing valve and respective delivery pressures of said variable displacement hydraulic pumps on said control sections, respectively.

Further, in accordance with the present invention, there is provided a control system for variable displacement hydraulic pumps characterized in that the input signal section of the control unit comprises a first piston arranged to receive the output pressure of the reducing valve thereby increasing the flow rate of the variable displacement hydraulic pump, at least two sets of compression springs adapted to apply a biasing force in the opposite direction to reduce the flow rate of said variable displacement hydraulic pump, a control piston means having an actuating arm connecting the servo piston section with the guide section, a second piston arranged to receive the delivery pressure of the fixed displacement hydraulic pump thereby increasing the flow rate of the variable displacement hydraulic pump, a third piston arranged to receive the output pressure of the reducing valve thereby reducing the flow rate of the variable displacement hydraulic pump, and fourth and fifth pistons respectively arranged to receive the delivery pressures of the variable displacement hydraulic pumps, respectively, thereby reducing the flow rate of the variable displacement hydraulic pump, wherein the foregoing components are aligned sequentially, and wherein the pressure receiving area of the third piston is equal to that of the first piston.

Further, in accordance with the present invention, there is provided a control system for variable displacement hydraulic pumps characterized in that at least two sets of compression springs are arranged such that their respective loading can be properly adjusted independently of each other.

Further, in accordance with the present invention, there is provided a control system for variable displacement hydraulic pumps characterized in that the reducing valve means comprises a first spring interposed between a first snap ring disposed in a spool insertion hole in the body and a first spring seat mounted in a reduced diameter portion of a manipulating rod inserted in said insertion hole and abutting against a stepped part of said rod; a second spring interposed between a third spring seat which is slidably mounted on the periphery of the reduced diameter portion of said manipulating rod and the position of which is defined by a second snap ring mounted on the leading end of the manipulating rod and a second spring seat which is slidably mounted on the periphery of the reduced diameter portion and the position of which is defined by said first snap ring, wherein the respective loadings or compressive forces of said first and second springs can be determined by the mounting position of said first snap ring, and the third spring seat abuts against a spool.

Further, in accordance with the present invention, there is provided a control system for variable displacement hydraulic pumps characterized in that the system further comprises a cut-off valve adapted to receive the delivery pressure of the variable displacement hydraulic pump to thereby convert it into the output pressure thereof, a sixth piston arranged in the input signal section to receive the output pressure of the cut-off valve thereby reducing the flow rate of the variable displacement hydraulic pump, and means adapted to allow the output pressure of the cut-off valve to be exerted on the sixth piston.

Still further, in accordance with the present invention, there is provided a control system for variable displacement hydraulic pumps characterized by in that said cut-off valve comprises a spool slidably mounted in the insertion hole formed in the body thereof; first and second sleeves fitted in the opposite sides of said insertion hole; a first piston slidably mounted in one of said sleeves opposite said spool and having a shoulder portion comprised of a stepped part; a second piston slidably mounted in the other of said sleeves opposite said spool and having a shoulder portion comprised of a stepped part; a springs retainer mounted on the spool so as to abut against the stepped part of said spool at a substantially intermediate position thereof; and a cut-off pressure setting spring interposed between said spring seat and said second sleeve, wherein the shoulder portion of said first piston serves as a pump discharge pressure receiving region and the shoulder portion of said second piston serves as a pressure receiving region.

BRIEF DESCRIPTION OF THE DRAWINGS

The above and many other advantages, features and additional objects of the present invention will become apparent to those skilled in the art upon making reference to the following detailed description and accompanying drawings in which preferred structural embodiments incorporating the principles of the present invention are shown by way of illustrative example.

DETAILED DESCRIPTION OF THE PREFERRED EMBODIMENTS

Figure 1:
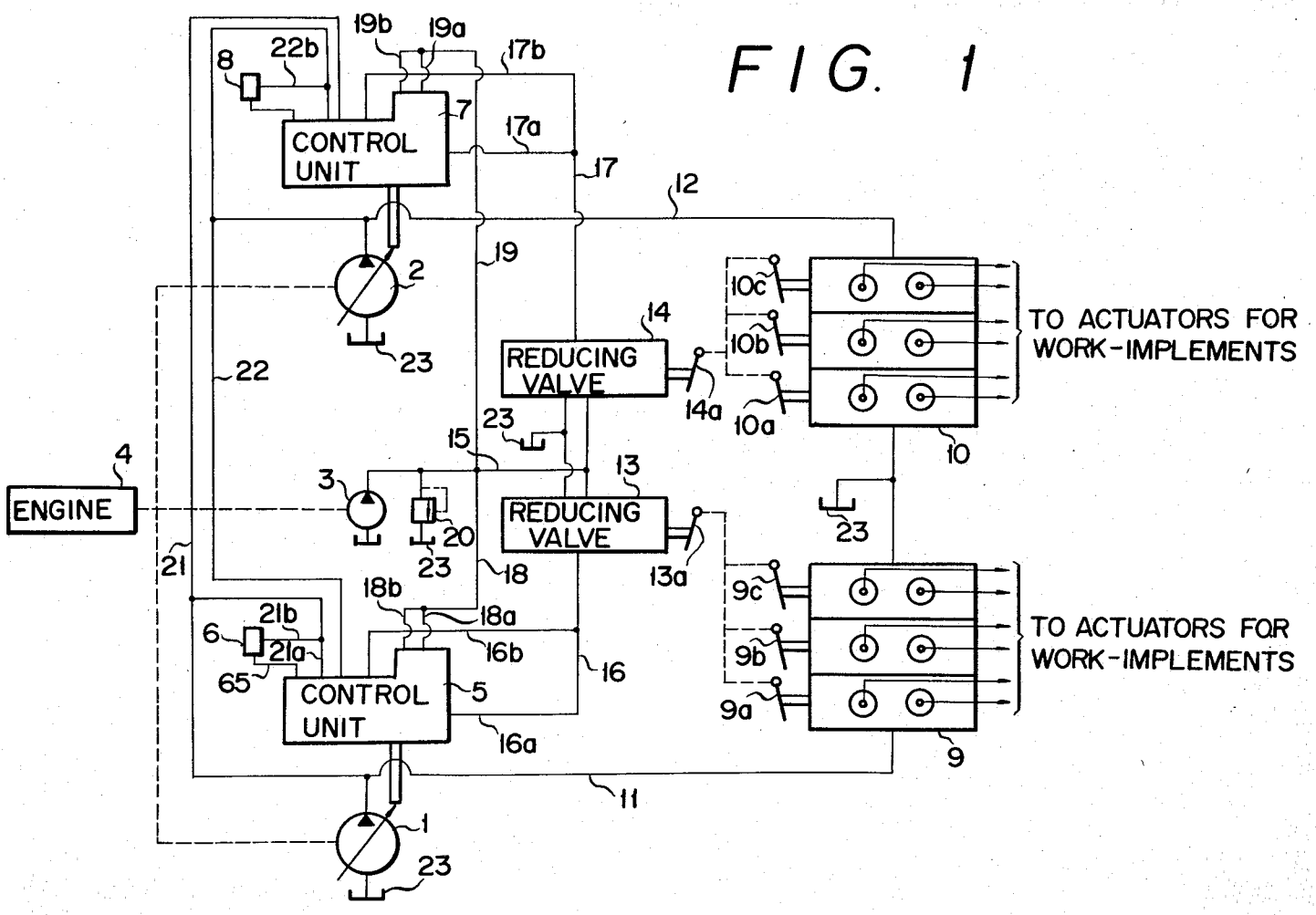
FIG. 1 is a schematic diagram of the arrangement of a control system for variable displacement hydraulic pumps according to one embodiment of the present invention.

The present invention will now be described in detail below by way of example only with reference to the accompanying drawings.

Reference numerals 1, 2 denote variable displacement hydraulic pumps (referred to simply as variable displacement pumps hereinbelow); and 3 a fixed displacement hydraulic pump (referred to simply as a fixed displacement pump hereinbelow) of a small capacity for supplying control pressure for a hydraulic servo mechanism, these pumps 1, 2 and 3 all being driven by an engine for common use; 5, 7 are control units for the variable displacement pumps 1, 2, respectively; and 6, 8 are cut-off valves for the variable displacement pumps 1, 2, respectively. Reference numeral 9 indicates a work-implement controlling valve unit, connected by way of a conduit 11 to the variable displacement pump 1; and 10 is a work-implement controlling valve unit (referred to simply as the valve unit hereinbelow), these valve units being connected, respectively, to actuators for work-implements not shown. Reference numerals 13 and 14, respectively denote a reducing valve. The reducing valve 13 has a lever 13*a* which is interlocked with levers 9*a*, 9*b* and 9*c* of the valve unit 9 and which is adapted to displace in proportion to the maximum displacement of each of the levers 9*a*, 9*b* and 9*c* and to control the delivery pressure of the fixed displacement pump 3 in proportion to the amount of the displacement thereof so as to transmit the fluid pressure to the control unit 5 by way of a conduit 16. In the similar manner, the reducing valve 14 has a lever 14*a* which is interlocked with levers 10*a*, 10*b* and 10*c* of the valve unit 10 and which is adapted to shift in proportion to the maximum displacement of each of levers 10*a*, 10*b* and 10*c* and to control the fluid pressure (delivery pressure) from the fixed displacement pump 3 in proportion to the displacement thereof to thereby transmit the fluid pressure to the control unit 7 by way of a conduit 17. Reference numeral 15 denotes a discharge conduit of the fixed displacement pump 3; 18, 19 are branch conduits leading to the control units 5 and 7, respectively; and 20 is a relief valve for the fixed displacement pump 3. Reference numerals 21 and 22 indicate conduits for supplying the pressurized fluid discharged by the variable displacement pumps 1 and 2 into control units 5 and 7, respectively; and 23 is a tank or reservoir for common use in the fluid circuits.

Figure 2:
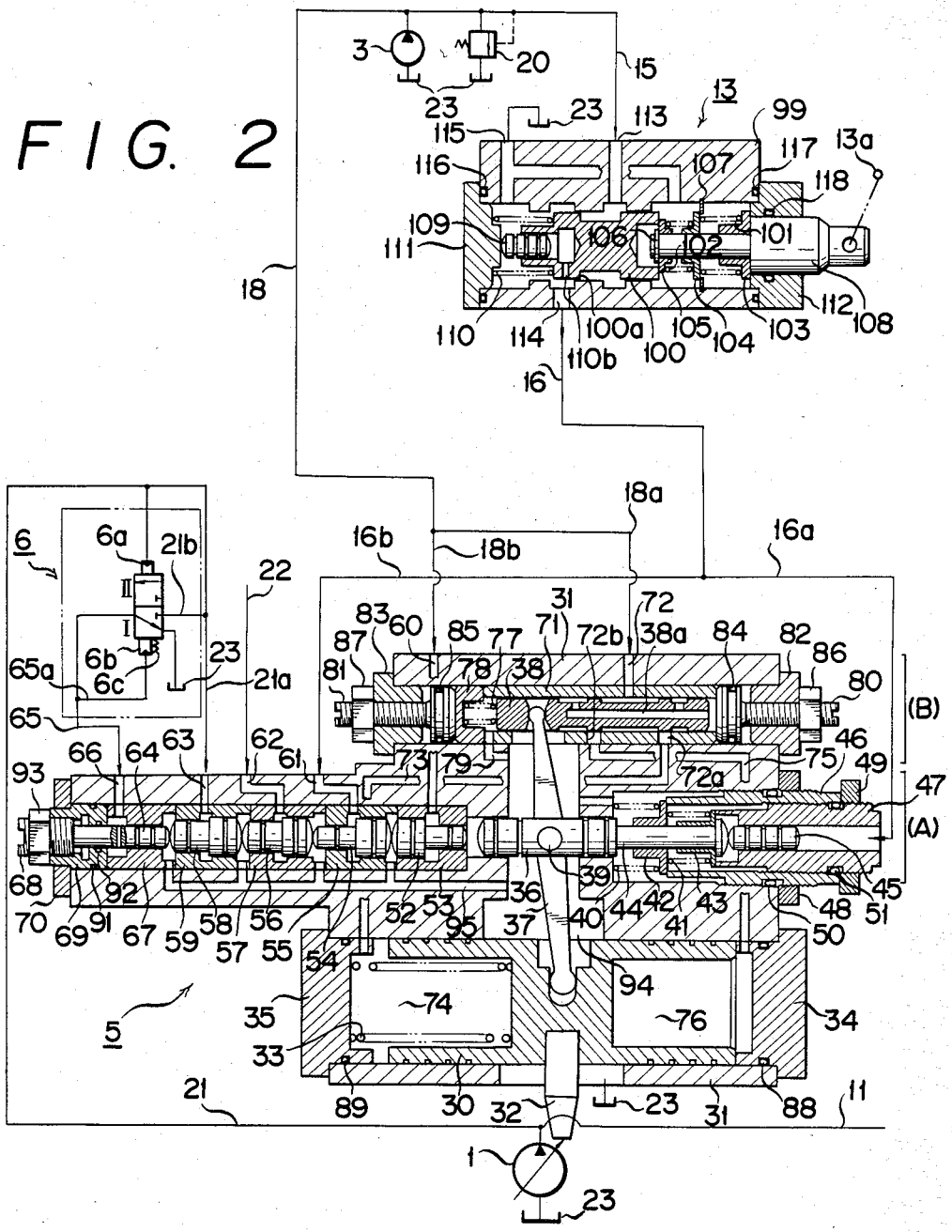
FIG. 2 is a sectional of the configuration of the control section of the control system of the present invention.

FIG. 2 shows the control section of the control system.

Because the arrangements of the variable displacement pumps 1 and 2 are symmetrical, only the variable displacement pump 1 will be described below and the description of the pump 2 is omitted for simplification of the explanation. In FIG. 2, there is shown the condition wherein the control unit 5, the reducing valve 13 and the valve unit 9 are located in their neutral positions and the variable displacement pump 1 is located at a minimum swash plate angular position.

Reference numeral 30 denotes a servo piston housed in a casing 31 and which is connected to the variable displacement pump 1 by means of a rod 32. Reference numeral 33 denotes a spring adapted to hold the variable displacement pump 1 at the minimum swash plate angular position when the valve unit 9 is held at its neutral position, and 34, 35 denote covers for the casing 31.

Reference character (A) denotes an input signal section of the control unit 5, and (B) denote a guide valve section.

Reference numeral 36 indicates a control piston which is connected to a guide valve spool 38 and the servo piston 30 by means of an arm 37. The arm 37 is connected to the control piston 36 by means of a pin 39, and is also connected to the servo piston 30 and the guide valve spool 38 by pivotally mounting spherical portions formed in both ends of the arm 37 which fit into slits formed in the piston 30 and spool 38. Reference numerals 40, 41 indicate springs for controlling the torque and for controlling the flow rate, respectively, two springs being used for obtaining a constant torque curve approximately corresponding to a bent line. When it is desired to obtain a constant torque curve approximately equal to a two-bent line, it is required to use three springs. Reference numerals 42 and 43 denote spring seats, and 44 a rod adapted to transmit the output pressure from the reducing valve 13 which is transmitted through the conduit 16*a* and which is exerted on the piston 45 and the resilient forces of the springs 40, 41 to the control piston 36. Reference numerals 46 and 47 denote sleeves serving to adjust the loadings or compressive forces of the springs 40 and 41, respectively; 48 and 49 are lock nuts for the sleeves 46 and 47, respectively; and 50 and 51 are seal members, respectively. Reference numerals 52 denotes a piston having a stepped portion serving as a pressure receiving surface adapted to receive the discharge pressure of the fixed displacement pump 3 which is transmitted by way of a conduit 18*b*; and 53 denotes a sleeve in which a piston 52 is accommodated. Reference numeral 54 indicates a piston adapted to receive the output pressure of the reducing valve 13 transmitted by way of the conduit 16*b*; 55 is a sleeve in which the piston 54 is accommodated; 56 is a piston adapted to be subjected to the discharge pressure of the variable displacement pump 2 transmitted by way of a conduit 22; 57 denotes a sleeve in which the piston 56 is accommodated; 58 a piston adapted to receive the discharge pressure of the variable displacement pump 1 which is transmitted by way of a conduit 21*a*; and 59 is a sleeve in which the piston 58 is slidably mounted. Reference numeral 60 denotes a passage formed in the casing to connect said conduit 18*b* with the piston 52; 61 is a similar passage formed in the passage to connect the conduit 16*b* with the piston 54; 62 denotes a passage formed in the casing to connect the conduit 22 with the piston 56; and 63 denotes a passage formed in the casing to connect the conduit 21*a* with the piston 58. Reference numeral 64 indicates a piston arranged to receive the output pressure of the control unit 6 through a conduit 65 and a passage 66 formed in the casing; 67 denotes a sleeve in which the piston 64 is slidably mounted; and 95 denotes a drain passage adapted to return the fluid which leaks through the pistons 52, 54, 56, 58 and 64 into a drain chamber 94 formed within the casing. Reference numeral 68 denotes a screw rod for adjusting the maximum angular position of the swash plate, and 69 denotes a sleeve with which the screw rod 68 is threadably engaged and whose shoulder portion is held by a flange 70, the flange 70 being fixedly secured to the casing 31 by means of bolts not shown. Reference numerals 91, 92 denote seal members, and 93 denotes a lock nut.

Next, the guide valve portion (B) will be described.

Reference numeral 71 denotes a sleeve in which the spool 38 is slidably mounted. The fixed displacement pump 3 is connected through the conduit 18*a* to a passage 72, and port 72*a* is connected through a passage 73 to a left chamber 74 of the servo piston. Further, port 72*b* is connected through a passage 75 to a right chamber 76. Reference numeral 77 denotes a spring adapted to merely hold the spool at the minimum swash plate angular position when the spool is not actuated thus preventing the play between the arm 37, the spool 38 and the servo piston 30; 78 is a spring seat, and 79 is a drain passage for the spring chamber. Reference numerals 80, 81 denote plugs adapted to change the position of the sleeve 71 to enable the neutral position of the servo system to be adjusted, said plugs 80, 81 being threadably engaged with covers 82 and 83, respectively, and being movable to the left and right to change the position of the sleeve 71. Reference numerals 84 and 85 denote seal members; and 86 and 87 denote lock nuts for the plugs 80 and 81, respectively. Further, reference numerals 88 and 89 indicate seal members for the covers 34 and 35, respectively.

In the next place, the reducing valve 13 will be described.

Reference numeral 100 denotes a control spool; 101 and 102 are springs adapted to determine the pressure reducing characteristic; 103, 104 and 105 are spring retainers, 106 is a snap ring fitted to the leading end of a rod 108; 107 is a snap ring fitted to a body 99, said snap rings 106 and 107 serving to set the position of the spring seats 104 and 105, respectively, so that a predetermined loading can be obtained for each of the springs. The loading and spring constants of the springs 101 and 102 are set as shown in Table 1 below.

TABLE 1

| | Loading | Spring constant |
|---|---|---|
| 101 | low | high |
| 102 | high | low |

Reference numeral 108 denotes a manipulating rod which is operatively interlocked with the valve unit 9.

Reference numeral 109 denotes a reaction piston adapted to be subjected to the output pressure of the reducing valve and to exert the resultant reaction force on the control spool 100; 110 is a spring adapted to hold the spool 100 at a blocking position when the spool is not actuated so as to render the output pressure ineffective; 111 and 112 are covers; and 113 and 114 are passages for the input pressure and output pressure of the hydraulic servo mechanism which are connected to conduits 15 and 16, respectively. Further, reference numeral 115 denotes a drain passage leading to a tank 23; and 116, 117 and 118 are seal members.

Figure 3:
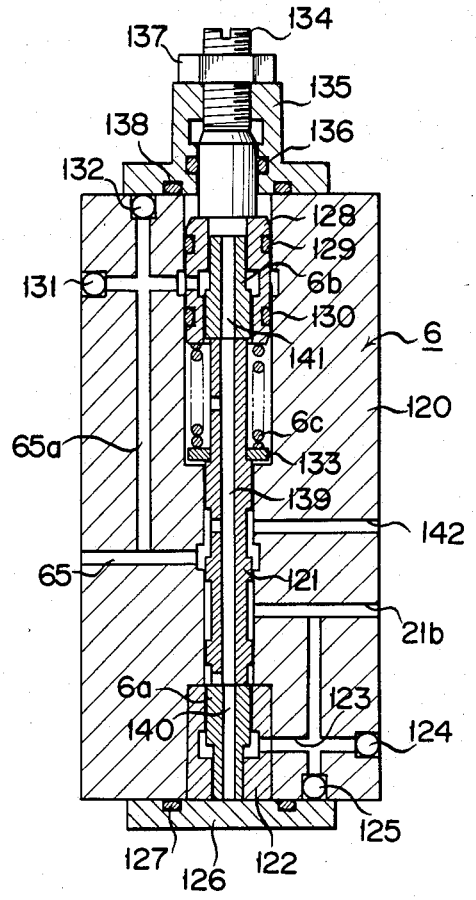
FIG. 3 is a sectional of the arrangement of a cut-off valve.

FIG. 3 shows a cut-off valve.

Reference numeral 120 denotes the valve body; 121 is a spool slidably mounted within the body 120; 21*b* denotes a passage in which the fluid pressure discharged by the variable displacement pump is introduced; and 123 denotes a branched passage of the passage passage 21*b*. Reference numeral 6*a* denotes a piston having a shoulder part formed thereon and which is adapted to receive the discharge pressure of the pump by way of the passage 123; 122 denotes a sleeve in which the piston 6*a* is inserted; 124 and 125 are blank plugs for the passage 123; 126 is a cover fitted to the body 120 by means of bolts not shown; and 127 is a seal member.

Reference numeral 65 indicates a passage for the output pressure of the cut-off valve, and 65*a* a branched passage thereof. Reference numeral 6*b* indicates a piston having a shoulder portion formed thereon and which is adapted to receive the output pressure of the cut-off valve from the passage 65*a;* 128 is a sleeve in which the piston 6*b* is inserted; 129 and 130 are seal members for preventing leaks of the fluid which are necessary for stabilizing the output pressure; and 131 and 132 are blank plugs for the passage 65*a*. Further, reference numeral 6*c* denotes a spring for setting the cut-off pressure; and 133 is a spring retainer.

Moreover, reference numeral 134 denotes a partially screw-threaded rod adapted to change the loading of the spring 6*c* to thereby adjust the cut-off pressure; and 135 is a cover with which the rod 134 is threadably engaged and which has a cylindrical portion sealed by a seal member 136. Reference numeral 137 indicates a lock nut for the screw-threaded rod 134; and 138 is a seal member. The cover 135 is fixedly secured to the body 120 by means of bolts not shown.

Reference numeral 139 denotes a passage formed inside the spool 121; 140 is a drain passage formed inside the piston 6*a;* and 141 is a drain passage formed inside the piston 6*b*, the drain passages 140 and 141 leading through a passage 142 to the tank or reservoir 23.

The operation of the control system according to the present invention will now be described below.

This control system has three control functions; that is, (a) controlling the flow rate of the hydraulic fluid to change the angular position of the swash plate of the pump in proportion to the work-implement control valve manipulating position, (b) constant torque control corresponding to the delivery pressures of the variable displacement pumps 1 and 2, and (c) cut-off control for reducing the relief loss.

The above-mentioned control functions will be described hereinbelow.

In this case too, only the side of the variable displacement pump 1 will be explained.

(1) Flow Rate Control

Figure 4:
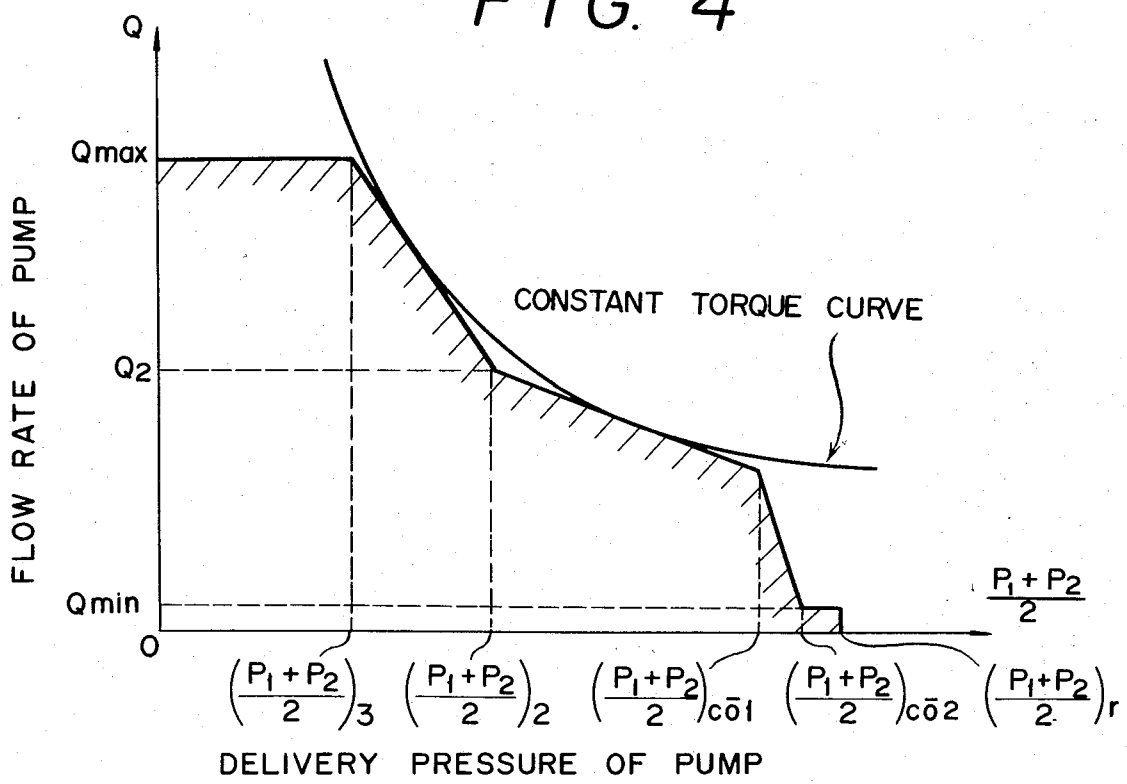
FIG. 4 is a characteristic diagram of the pump showing the relationship between delivery pressure and flow rate thereof.

FIG. 4 is a chacteristic curve showing the relationship between the delivery pressure of the pump and the flow rate of the fluid discharged thereby. When the flow rate of the pump is controlled, the pump delivery pressure is kept below a constant torque curve and inside the hatched part.

At that time, the force due to the delivery pressure of the fixed displacement pump 3 which is applied to the piston 52 is more than that which is exerted on the pistons 54, 56, 58 and 64 so that the pistons mounted to the left of the piston 52 may be maintained in abutting relationship with the screw rod 68.

The loading and spring constants of the springs 40 and 41 are set as shown in Table 2 below.

TABLE 2

| | loading | Spring constant |
|---|---|---|
| 40 | high | low |
| 41 | low | high |

By manipulation of the valve unit 9, the reducing valve operatively interlocked therewith is rendered operative to increase the output pressure thereof. When the fluid pressure exerted on the piston 45 exceeds the loading of the spring, the rod 44 will move to the left in FIG. 2 to a position where the force of the spring 41 may balance with the force created by the fluid pressure thereby moving the piston 36 to the left. As a result, the guide valve spool 38 connected to piston 36 by the arm 37 will be displaced to the left. Consequently, the passage 72 for introducing the pressure generated by the servo fluid pressure source will communicate with the port 72*b* so that the pressure of the hydraulic servo mechanism may be introduced into the right hand chamber 76 of the servo piston 30 and the latter will move to the left by the action of the fluid pressure force. In consequence, the arm 37 will turn clockwise about the pin 39 to return the spool 38 to its original position. The servo piston 30 will continue leftward movement until the spool 38 returns to its original position to thereby block or close the port 72*b* again.

At that time, the left-hand chamber 74 is allowed to communicate through the passage 73, the port 72*a*, and the passage 38*a* of the spool 38 with the casing drain 94.

Figure 5:
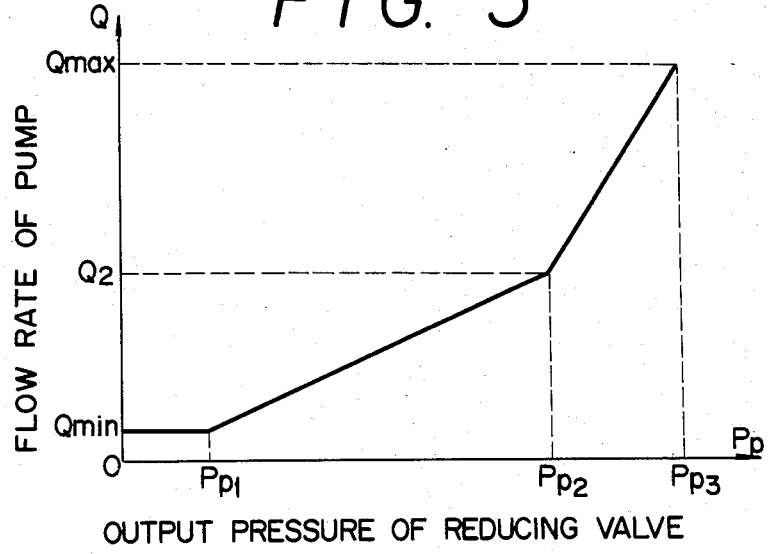
FIG. 5 is a diagram showing the relationship between outlet or output pressure of a reducing valve and flow rate of the pump.

Stating in brief, the servo piston 30 will displace in proportion to the output pressure of the reducing valve 13 to tilt the swash plate of the pump from the minimum angular position thereof to a position corresponding to the output pressure of the reducing valve. When the output pressure of the reducing valve increases further, the left end of the spring seat 43 will abut against the right end of the spring seat 42 to allow the spring 40 to commence deflection. At that time, the relationship between the output pressure of the reducing valve 13 and the angle of the swash plate of the pump is determined by the spring constant of the spring 40. If and when the loading of the spring 40 is set at a value equal to the loading of the spring 41 in such a case that the spring seats 42 and 43 are abutting against the sleeves 46, 47 the relationship between the output pressure of the reducing valve 13 and the angle of the swash plate of the pump or the flow rate thereof will become as shown in FIG. 5.

Figure 6:
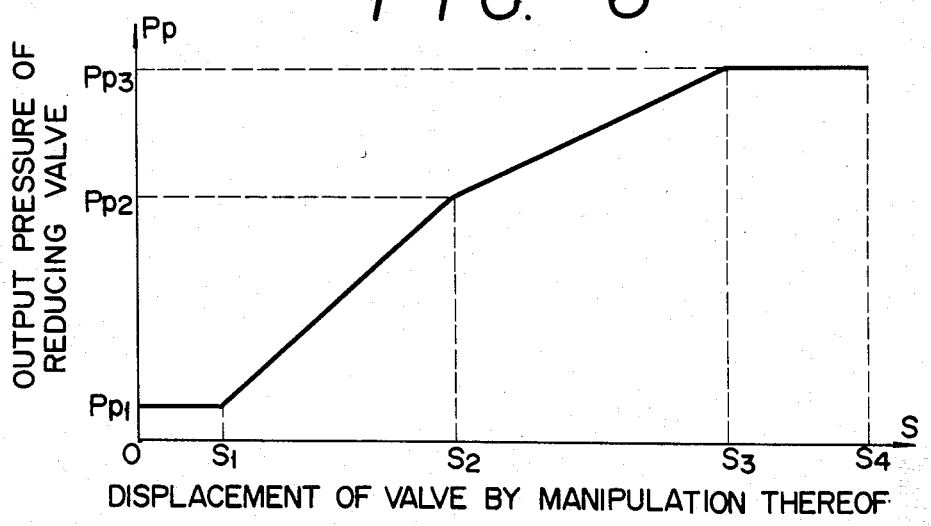
FIG. 6 is a characteristic diagram showing the relationship between displacement of the valve by the manipulation thereof and output pressure of the reducing valve.

Next, the relationship between the displacement of the valve unit 9 by the manipulation thereof and the output pressure of the reducing valve 13 will be described. The manipulating rod 108 of the reducing valve 13 will, as aforementioned, displace in proportion to the maximum value of displacement of each lever of the valve unit 9. When the rod 108 is displaced to the left in FIG. 2, the spring 110 will deflect to displace the spool 100 to the left because the loading of the spring 110 is lowest. As a result, the shoulder portion of the spool 100 will communicate with the port 114 to permit the pressure discharged by the servo fluid pressure supply to exert through the bore 110*b* on the piston 109 so that the resultant reaction force may act to displace the spool 100 to the right. At this position, pressure reduction will commence. When the rod is displaced further to the left, the spring 101 will deflect to such a degree as to balance with the force to displace the rod 108 to the left because of the relationship of the loading of the springs shown in Table 1. This force is also exerted through the spring seats 104, 105 and the spring 102 the spool 100, and the output pressure of the reducing valve 13 exerted on the piston 109 will increase to such a degree as to balance with the above-mentioned force. Further, when the left end of the spring seat 103 abuts against the right end of the spring seat 104, the spring 102 begins to deflect. At that time, the spring constant of the spring 102 determines the slope of the varying outlet pressure of the reducing valve 13. In brief, the output pressure characteristic of the reducing valve 13 is determined by the loadings of the springs 101 and 102 and the spring constant thereof. If the loading of the spring 102 is set at an equal value to that of the spring 101 such that the spring seat 103 is allowed to abut against the spring seat 104, the relationship between the displacement of the valve by the manipulation thereof and the output pressure of the reducing valve will become as shown in FIG. 6.

Figure 7:
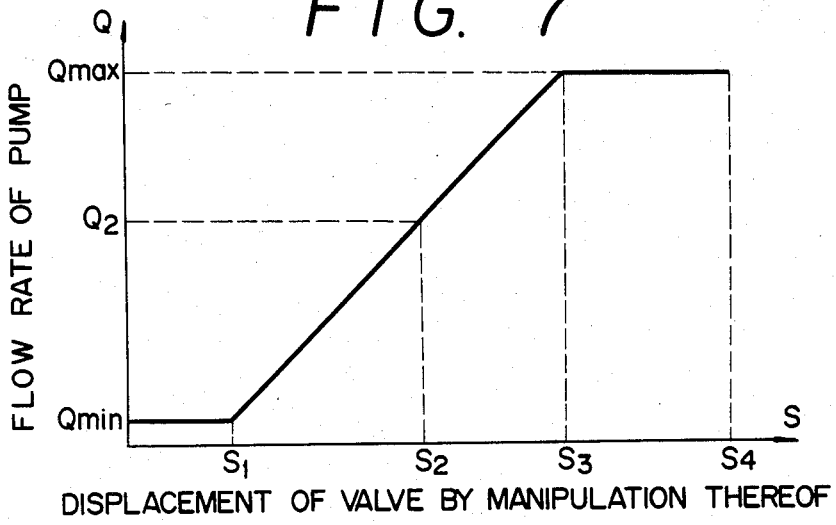
FIG. 7 is a characteristic diagram showing the relationship between displacement of the valve by the manipulation thereof and flow rate of the pump.
Figure 8:
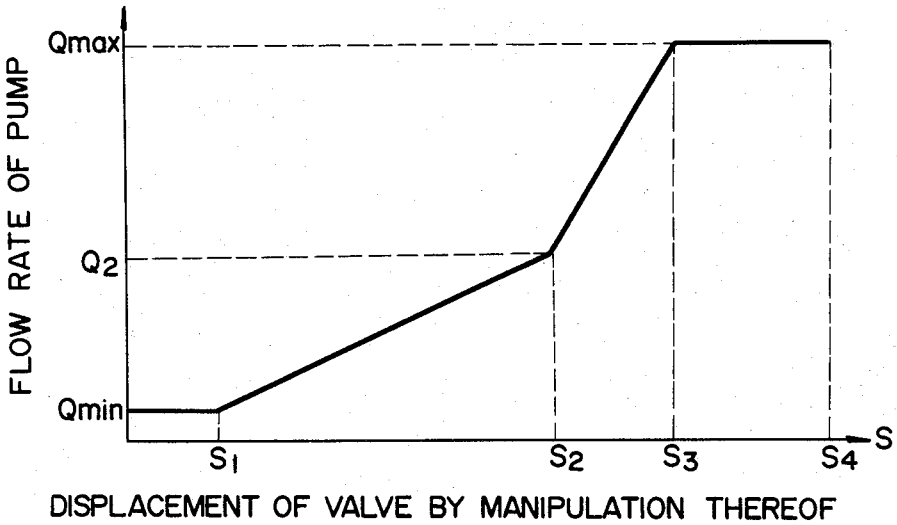
FIG. 8 is a characteristic diagram showing the relationship between displacement of the valve by the manipulation thereof and flow rate of the pump.

In this case, if the spring constants of the springs 41, 101 and 40 are set at an equal value, a rectilinear relationship can be obtained between the discharge flow rate of the pump and the displacement of the work implement controlling valve by the manipulation thereof as shown in FIG. 7.

However, when it is preferrable for inching operation of the actuator to obtain the relationship between the displacement of the work implement controlling valve by its operation and the discharge flow rate of the pump as shown in FIG. 7 wherein the flow rate of the pump will increase slowly relative to the displacement of the work implement controlling valve in the initial step and then increase sharply, one set of spring constants is used for the spring 101 and 102 of the reducing valve 13. Further, it is possible to reduce the spring constant of the spring 101 and increase that of the spring 102.

(2) Constant Torque Control

It is now assumed that the valve unit 9 is displaced to its maximum valve, whilst the flow rate of the pump is Qmax corresponding thereto. This corresponds to the condition in FIG. 2 wherein the left end of the piston 36 abuts against the right hand end of the piston 52, and the left hand end of the servo piston 30 abuts against the cover 35.

If, under this condition, the delivery pressures of the variable displacement pumps 1 and 2 increase so as to increase the force due to the delivery pressure of the fixed displacement pump 3 exerted on the piston 52 and also that due to the output pressure of the reducing valve 13 exerted on the piston 45, then the piston 36 is moved to the right in FIG. 2. If the area of the piston 54 and that of the piston 45 both of which are subjected to the output pressure of the reducing valve 13 are set at an equal value, the force exerted on the piston 45 will be offset by the force exerted on the piston 54. Stating in brief, under the constant torque control, a force equilibrium can be maintained between the delivery pressure of the variable displacement pump 2 exerted on the piston 56 and that of the variable displacement pump 1 exerted on the piston 58 plus the biasing force of the spring exerted on the rod 44 and the force due to the delivery pressure of the fixed displacement pump 3 exerted on the piston 52 in the opposite direction. As is aforementioned, the piston 36 will move to the right so as to balance with the delivery pressure of the fixed displacement pump 3 exerted on the piston 52 at a position where the load on the spring is reduced by the force due to the increase in the delivery pressures of the variable displacement pumps 1 and 2.

As a result, the guide valve spool 38 will move to the right in FIG. 2, and the servo piston will also move to the right in the similar operation as mentioned in the foregoing item (2) so that the guide valve spool 38 may be kept in balance again at its blocked position.

As can be seen from FIG. 4, when the delivery pressures of the variable displacement pumps 1 and 2 increase from the valve Qmax so as to allow the average of them to reach a value of $$\left(\frac{P_1 + P_2}{2}\right)_3$$

wherein $P_1$ and $P_2$ denote delivery pressures of the pumps 1 and 2, respectively, the spring begins to move backwards together with the piston 36 thereby reducing the flow rate of the pump. Further, when the delivery pressures of the variable displacement pumps 1 and 2 increase further, the seat 42 of the spring 40 is allowed to abut against the left end of the sleeve 46 so that the spring 41 may commence to move backward. Because the spring constant of the spring 40 is lower than that of the spring 41, the amount of the backward movement of the spring 40 to balance with the increase in the delivery pressures of the variable displacement pumps 1 and 2 will increase, and therefore the reduction in the flow rates of the pumps 1 and 2 will increase.

Whilst, because the spring 41 has a higher spring constant, it may be brought in equilibrium with a slight backward movement for the same increase in delivery pressure, and therefore the reduction in the flow rate is small. In brief, the control characteristic along the constant torque curve shown in FIG. 4 can be obtained. In FIG. 4, the value of $$\left(\frac{P_1 + P_2}{2}\right)_2$$

corresponds to the pressure at which the spring 41 begins to move backward.

(3) Cut-off Control

When the delivery pressure of the variable displacement pump 1 increases to a preset value of the spring 6*c*, the cut-off valve 6 is changed from (I) to (II) by the delivery pressure of the pump 1 exerted on the piston 6*a* so that the delivery pressure may be transmitted through conduit 65 and thence through conduit 65*a* on the piston 6*b* to thus reduce the fluid pressure.

Figure 9:
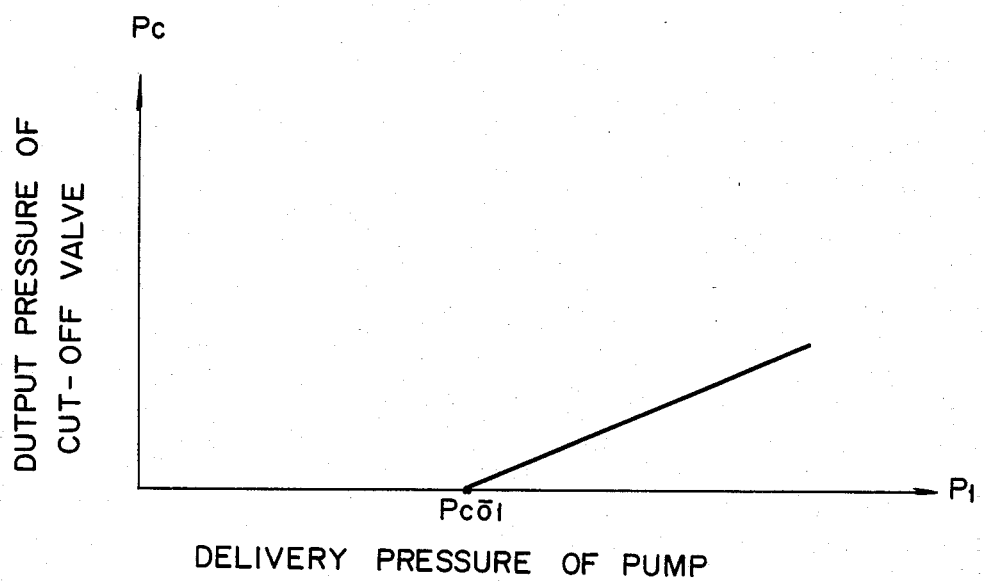
FIG. 9 shows the control characteristic of the cut-off valve.

Stated in brief, the delivery pressure of the variable displacement pump 1 which is exerted on the piston 6*a* will be kept in equilibrium with the loading of the spring 6*c* plus the output pressure Pc of the cut-off valve 6 which is exerted on the piston 6*b*. The pressure reduction characteristic obtained at that time is shown in FIG. 9 wherein $P\bar{c}ol$ denotes the pressure where the cut-off operation is started.

The cut-off output pressure Pc which is introduced through the conduit 65 into the passage 66 is exerted on the piston 64, and at that time the spring 41 will move backward further by an amount corresponding to the force exerted on the piston 64 until it may be kept in equilibrium. This corresponds in FIG. 4 to the pump delivery pressure between the values $$\left(\frac{P_1 + P_2}{2}\right)_{\bar{c}ol} \text{ and } \left(\frac{P_1 + P_2}{2}\right)_{\bar{c}o2}.$$

If, in FIG. 4, the delivery pressures of the variable pumps 1 and 2 increase further, the pumps 1 and 2 will assume their respective minimum swash plate angular positions which correspond to their respective positions of minimum flow rate Qmin. And, only their pressures will increase to the relief set pressure of the circuit $$\left(\frac{P_1 + P_2}{2}\right)_r,$$

and so the pressure can be kept through a small relief flow rate Qmin.

It is to be understood that the foregoing description it merely illustrative of preferred embodiments of the invention and that the invention is not to be limited thereto, but is to be determined only by the appended claims.

What is claimed is:

1. A control system for variable displacement hydraulic pumps comprising:

(a) a fixed displacement hydraulic pump for supplying a control fluid pressure for a hydraulic servo mechanism;

(b) a plurality of reducing valve means operatively interlocked with work implement control valve units disposed on the delivery sides of a plurality of variable displacement hydraulic pumps, said reducing valve means being adapted to convert the delivery pressure of said fixed displacement hydraulic pump into the output pressure of the reducing valve in proportion to respective displacements of said control valve units by the manipulation thereof;

(c) control units for controlling respective flow rate of said variable displacement pumps, each control unit including a servo piston section adapted to selectively receive the delivery pressure of said fixed displacement hydraulic pump on either side thereof to thereby control the delivery pressures of said variable displacement hydraulic pumps, a guide section adapted to control the delivery pressure of said fixed displacement hydraulic pump to selectively direct it on either side of said servo piston section, and an input signal section adapted to receive the delivery pressure of said fixed displacement hydraulic pump, the output pressure of said reducing valve means and respective delivery pressures of said variable displacement hydraulic pumps so as to control said guide section; and (d) means adapted to exert the delivery pressure of said fixed displacement hydraulic pump, the output pressure of said reducing valve and respective delivery pressures of said variable displacement hydraulic pumps on said control units, respectively.

2. The control system as claimed in claim 1, characterized in that said reducing valve means comprises a first spring interposed between a first snap ring disposed in a spool insertion hole in the body and a first spring seat mounted in a reduced diameter portion of a manipulating rod inserted in said insertion hold and abutting against a stepped part of said rod; and a second spring interposed between a third spring seat which is slidably mounted on the periphery of the reduced diameter portion of said manipulating rod and the position of which is defined by a second snap ring mounted on the leading end of the manipulating rod and second spring seat which is slidably mounted on the periphery of said reduced diameter portion and the position of which is defined by said first snap ring, wherein the respective loadings or compressive forces of said first and second springs can be determined by the mounting position of said first snap ring, and said third spring seat abuts against a spool.

3. The control system as claimed in claim 1, characterized in that said cut-off valve comprises a spool slidably mounted in the insertion hole formed in the body thereof; first and second sleeves fitted in on the opposite sides of said insertion hole; a first piston slidably mounted in one of said sleeves opposite to said spool and having a shoulder portion comprised of a stepped part; a second piston slidably mounted in the other of said sleeves opposite to said spool and having a shoulder portion comprised of a stepped part; a spring retainer mounted on the spool so as to abut against the stepped part of said spool at a substantially intermediate position thereof; and a cut-off pressure setting spring interposed between said spring seat and said second sleeve, wherein the shoulder portion of said first piston serves as a pump discharge pressure receiving region and the shoulder portion of said second piston serves as a pressure receiving region.

4. The control system as claimed in claim 1, characterized in that said input signal section of the control unit comprises;

(a) a first piston arranged to receive the output pressure of said reducing valve thereby increasing the flow rate of said variable displacement hydraulic pump;

(b) at least two sets of compression springs adapted to apply a biasing force in the opposite direction to reduce the flow rate of said variable displacement hydraulic pump;

(c) a control piston means having an actuating arm connecting said servo piston section with said guide section;

(d) a second piston arranged to receive the delivery pressure of said fixed displacement hydraulic pump thereby increasing the hydraulic flow rate of said variable displacement hydraulic pump;

(e) a third piston arranged to receive the output pressure of said reducing valve thereby reducing the flow rate of the variable displacement hydraulic pump; and (f) fourth and fifth pistons respectively arranged to receive the delivery pressures of said variable displacement hydraulic pumps, respectively, thereby reducing the flow rate of said variable displacement hydraulic pump, wherein said components are aligned sequentially, and wherein the pressure receiving area of said third piston is equal to that of said first piston.

5. The control system as claimed in claim 4, said at least two sets of compression springs are arranged such that their respective loading can be properly adjusted independently of each other.

6. The control system as claimed in claim 4, characterized by further comprising a cut-off valve adapted to receive the delivery pressure of said variable displacement hydraulic pump to thereby convert it into the output pressure thereof, a sixth piston arranged in said input signal section to receive the output pressure of said cut-off valve thereby reducing the flow rate of said variable displacement hydraulic pump, and means adapted to allow the output pressure of said cut-off valve to be exerted on said sixth piston.

* * * * *